US007618223B1

(12) United States Patent
Begley

(10) Patent No.: US 7,618,223 B1
(45) Date of Patent: Nov. 17, 2009

(54) DOCK TO BOAT TRANSFER AID FOR HANDICAPPED BOATERS

(75) Inventor: Adam Begley, Lake Leelanau, MI (US)

(73) Assignee: Handicaptain Brands, LLC, Traverse City, MI (US)

( * ) Notice: Subject to any disclaimer, the term of this patent is extended or adjusted under 35 U.S.C. 154(b) by 0 days.

(21) Appl. No.: 12/112,599

(22) Filed: Apr. 30, 2008

(51) Int. Cl.
*B66B 9/08* (2006.01)

(52) U.S. Cl. ..... 414/139.4; 114/44; 114/362; 187/200; 212/71; 414/921

(58) Field of Classification Search ..... 114/44, 114/45, 362; 187/200; 212/71; 405/3; 414/139.5, 414/139.6, 139.7
See application file for complete search history.

(56) References Cited

U.S. PATENT DOCUMENTS

| | | | | |
|---|---|---|---|---|
| 2,854,154 | A | 9/1958 | Hepinstall | |
| 3,082,887 | A * | 3/1963 | Brooks, Jr. | 414/266 |
| 3,656,637 | A * | 4/1972 | Lynn et al. | 414/542 |
| 3,696,947 | A | 10/1972 | Ponsen | |
| 3,804,268 | A | 4/1974 | Barron et al. | |
| 3,981,484 | A | 9/1976 | James | |
| 4,395,178 | A | 7/1983 | MacDonell et al. | |
| 4,505,619 | A * | 3/1985 | Sargent | 405/220 |
| 4,588,155 | A | 5/1986 | James | |
| 4,739,721 | A | 4/1988 | Peyre | |
| 4,805,248 | A | 2/1989 | Lunau | |
| 4,858,775 | A | 8/1989 | Crouch | |
| 4,954,011 | A * | 9/1990 | Stenson | 405/3 |
| 5,062,165 | A | 11/1991 | Kerr | |
| 5,694,654 | A * | 12/1997 | Roy | 5/83.1 |

(Continued)

FOREIGN PATENT DOCUMENTS

FR 2 817 736 * 6/2002

(Continued)

OTHER PUBLICATIONS

Crewlift, Crewlift Operation, www.crewlift.com/operation.htm (webpage), Jan. 17, 2006, 2 pages, www.crewlift.com, US (Internet).

(Continued)

*Primary Examiner*—Thomas J. Brahan
(74) *Attorney, Agent, or Firm*—Northern Michigan Patent Law, PLC

(57) ABSTRACT

A personal transfer device for transferring a boater from a dock to a boat moored in a boat lift adjacent the dock, and back again. A cantilevered support is secured to an upper part of the boat lift frame, the support's free end extending out over the dock at a height that does not interfere with normal use of the dock. A hoist carriage, for example a monorail trolley hoist, is movably secured on the cantilever support, and is connected to a transport chair that can be located over the dock at a convenient height for a handicapped boater to seat and/or secure himself. A controller is accessible to the boater seated in the transport chair to raise himself off the dock to a height sufficient to clear any intervening boat lift structures or frame members, and to then transport himself horizontally along the support through the boat lift structure to the boat, where he then lowers himself onto the boat using the controller.

9 Claims, 9 Drawing Sheets

U.S. PATENT DOCUMENTS

| | | | | |
|---|---|---|---|---|
| 2002/0092820 | A1 | 7/2002 | Chattey | |
| 2008/0066241 | A1* | 3/2008 | Evans | 14/69.5 |

FOREIGN PATENT DOCUMENTS

| | | | |
|---|---|---|---|
| KR | 2003-044930 A | * | 6/2003 |
| WO | 99/25301 | * | 5/1999 |

OTHER PUBLICATIONS

Marina Dock Age Magazine, Marina Meets ADA Challenges with Ingenuity, www.cdnsafety.com/articles/marina_dock.htm, Oct. 28, 2005 or earlier, Canadian Safety Equipment, US.

Sunrise Medical, Guardian Voyager with Easytrack Portable Ceiling Lift System, brochure, 2001, 8 pages, www.planetmobility.com, US.

* cited by examiner

DOCK TO BOAT TRANSFER AID FOR HANDICAPPED BOATERS

FIELD OF THE INVENTION

The invention is in the field of lifts for transferring handicapped boaters between docks and moored boats.

BACKGROUND OF THE INVENTION AND DESCRIPTION OF RELATED ART

Many boaters suffer from physical handicaps that make it difficult or risky for them to go back and forth between a dock and a moored boat on their own, or that require help from others who might themselves be put at risk in helping with the transfer.

Ships, loading docks and oilrig platforms are known to use large cargo and personnel transfer capsules and cages, often moved with gantry-type cranes, to transfer people and cargo between a ship and the dock or platform.

Large boats and large permanent docks are often provided with devices such as extendable ramps to help handicapped boaters, especially wheelchair users, to get from the dock to the boat and back again.

Smaller recreational boats and smaller docks typically lack room and support (and sometimes stability) for cranes and ramps. It is accordingly also known to use small dock-based swiveling lifts or hoists to transfer handicapped boaters on and off their boats. These use a fairly permanent mounting, take up significant space on the dock, and appear to require other people on the dock to operate the equipment and assist with loading and transfer. The handicapped boater himself generally seems to remain a passive transferee, which is often unsatisfying and might lead in some cases to giving up the enjoyable pastime of boating.

U.S. Pat. No. 5,709,154 to Schott discloses a boat-mounted monorail access system for making a boat handicapped-accessible. A battery powered chair assembly is suspended from an overhead monorail track system installed throughout the boat, whereby by activating a control mechanism an individual may maneuver anywhere in the boat where track is installed. Once an individual is seated in the chair assembly, the monorail system allows the individual to travel to the cabins, flying bridge, downstairs to the galley, outside to the rear deck for sunbathing or fishing or over the side to a dock. As an additional feature, a length of overhead track coupled to a hinge mechanism may be provided whereby the track may swing out over the side of the boat supported by a boom or to a support located on the dock, thereby permitting the monorail access system to be used to enter and disembark the boat. This system, however, appears to be expensive, complex to install, and suitable only for relatively large boats. It further requires additional boom and support structure on the boat and/or on the dock in order to transfer the boater between boat and dock, and the transfer would be subject to the rocking of the boat.

It is also known to use lifts and hoists for general invalid/patient/handicapped use in homes, hospitals, and even for raising and lowering people into and out of swimming pools. Examples include U.S. Pat. Nos. 6,085,368 to Robert et al.; 4,805,248 to Lunau; 6,315,138 to Dyson; 5,062,165 to Kerr; and 3,981,484 and 4,588,155 to James.

None of the foregoing transfer devices is particularly suitable for use in transferring people between small, often seasonal, docks in shallow water and small recreational boats housed in boat lifts.

Boat lifts come in different styles, but they generally have a rectangular frame anchored in the lakebed and a movable cradle that raises and lowers the boat into and out of the water next to the dock in response to a manual or electric lift drive. The boat lift surrounds the boat, and is often roofed with a canopy to protect the boat. Boats moored in such boat lifts present a special boarding challenge for handicapped boaters. The extra spacing from the dock created by the lift; the surrounding frame, lift cradle, and canopy structure; and the small, sometimes rickety nature of the dock make the use of traditional boat-side and dockside transfer devices impractical. The usual alternative is to rely on personal lifting help from family and friends, which can be risky for all involved.

BRIEF SUMMARY OF THE INVENTION

According to the invention, a boater's personal transfer device includes a cantilevered beam secured to the upper frame of a boat lift above a boat moored in the lift, with the free end of the beam extending out over the dock; and a self-operated reciprocating hoist carriage movable along the beam above the dock and the boat. A personal carrier such as a sling or chair or harness (or combination thereof) is coupled to the hoist carriage, preferably in detachable fashion, to lift a person in the carrier clear of the lower parts of the boat lift frame and the side of the boat, to transfer the person horizontally to a desired location in the boat, and to lower the person (if needed) to the desired spot in the boat. Reversing the procedure transfers the person off the boat onto the dock.

Once the handicapped boater is seated or secured in the carrier, the boater himself preferably controls the hoist carriage's movement, either manually or through a control unit depending on whether the hoist carriage is manual or powered. For example, with a motor-driven hoist carriage, a control unit is associated with the carrier, and travels with the carrier to let the occupant control the transfer operation in self-sufficient fashion.

The transfer device can also be operated by a helper or caregiver, if desired, with corresponding controls if the hoist carriage is powered.

In the preferred form, the carrier is initially positioned on a temporary support (for example a chair or wheelchair) on the dock, and the harness-secured boater is lifted clear of the temporary support for the transfer operation. The boater can be conveniently secured in the carrier at the dock and then rest on the temporary support while waiting to be hooked to the hoist carriage. If the carrier is a flexible harness or sling, the boater could put the flexible carrier on at a convenient location remote from the dock, and then wear the flexible carrier to the dock for attachment to the hoist carriage.

These and other features and advantages of the invention will become apparent from the detailed description below, in light of the accompanying drawings.

DETAILED DESCRIPTION OF THE INVENTION

Figure 1:
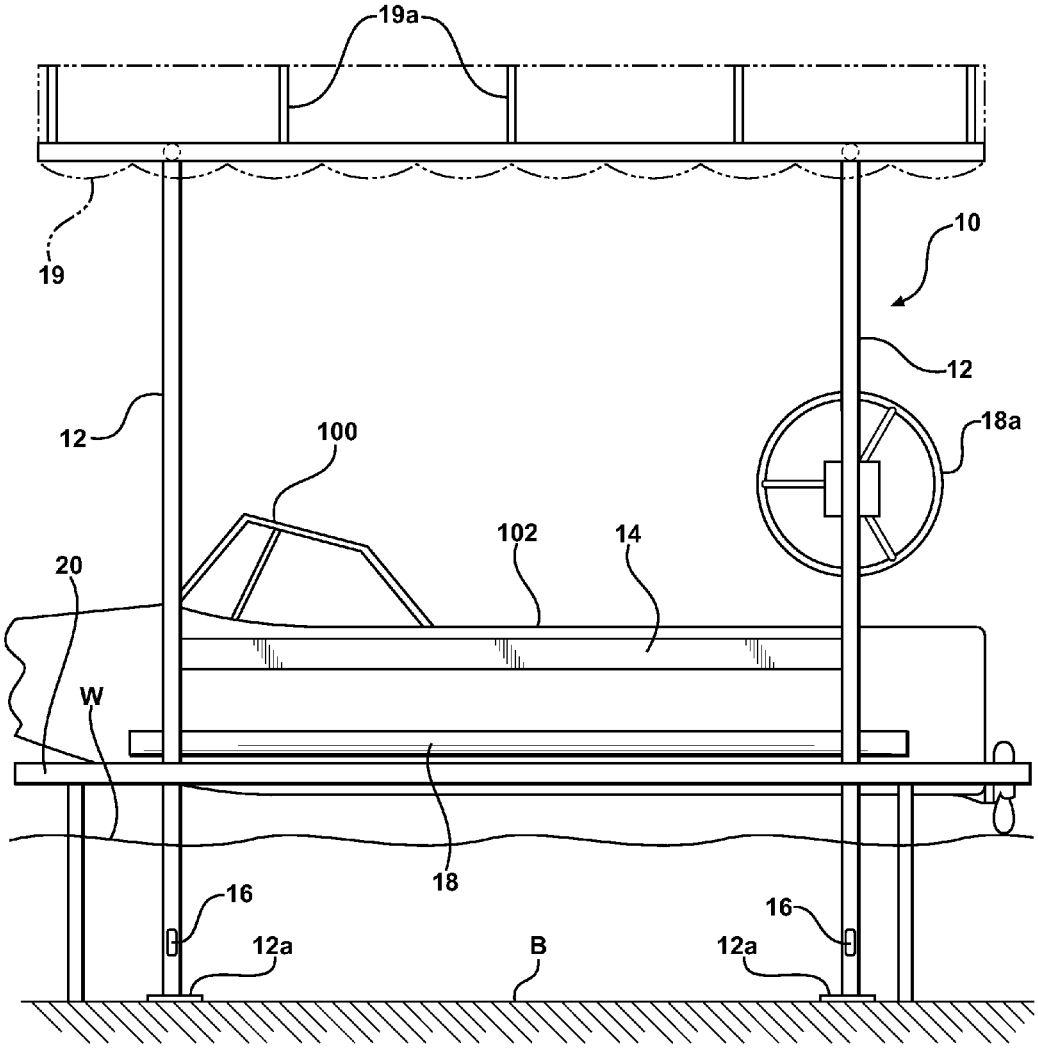
FIG - 1 PRIOR ART
FIG. 1 is a perspective view of a conventional boat lift, viewed from the dock.

Referring first to FIG. 1, a conventional boat lift 10 containing a boat 100 is illustrated next to a seasonal (in for spring, out for winter) dock 20. Illustrated boat lift 10 represents a typical seasonal, shallow-water boat lift in somewhat schematic fashion, since many different makes and models of this type of boat lift are known and commercially available and will lend themselves to use with the invention with only minor modification. Boat lift 10 generally includes four or more supporting pipe columns 12 anchored on lake bottom B with feet 12*a*; side frame members 14 connecting and bracing pipe columns 12 on the long sides of the boat lift; and fore and aft end frame members 16 connecting and bracing pipe columns 12 on the ends of the boat lift, below the waterline W to provide clearance for the boat 100 as it enters and exits the boat lift. End frame members 16 generally have a shallow V-shape or curve to give clearance for the hull of boat 100 when the boat is in the water. A known type of cradle lift 18 is operated by a wheel crank 18*a* to permit a person on the dock or on the boat to raise and lower boat 100 out of and into the water as needed. Wheel crank 18*a* can be manual or powered, usually electrically, and it will be understood by those familiar with boat lifts that different cradle and lift mechanisms are available for use with the boat lift.

Boat lift 10 is often covered with a canopy 19 supported by canopy frame members 19*a* to protect the boat from weather and birds, and to provide shade.

The structural pieces of boat lift 10 described above are typically made from corrosion resistant metals such as aluminum or galvanized steel or stainless steel, while the canopy 19 is usually made from natural or synthetic canvas.

Figure 2:
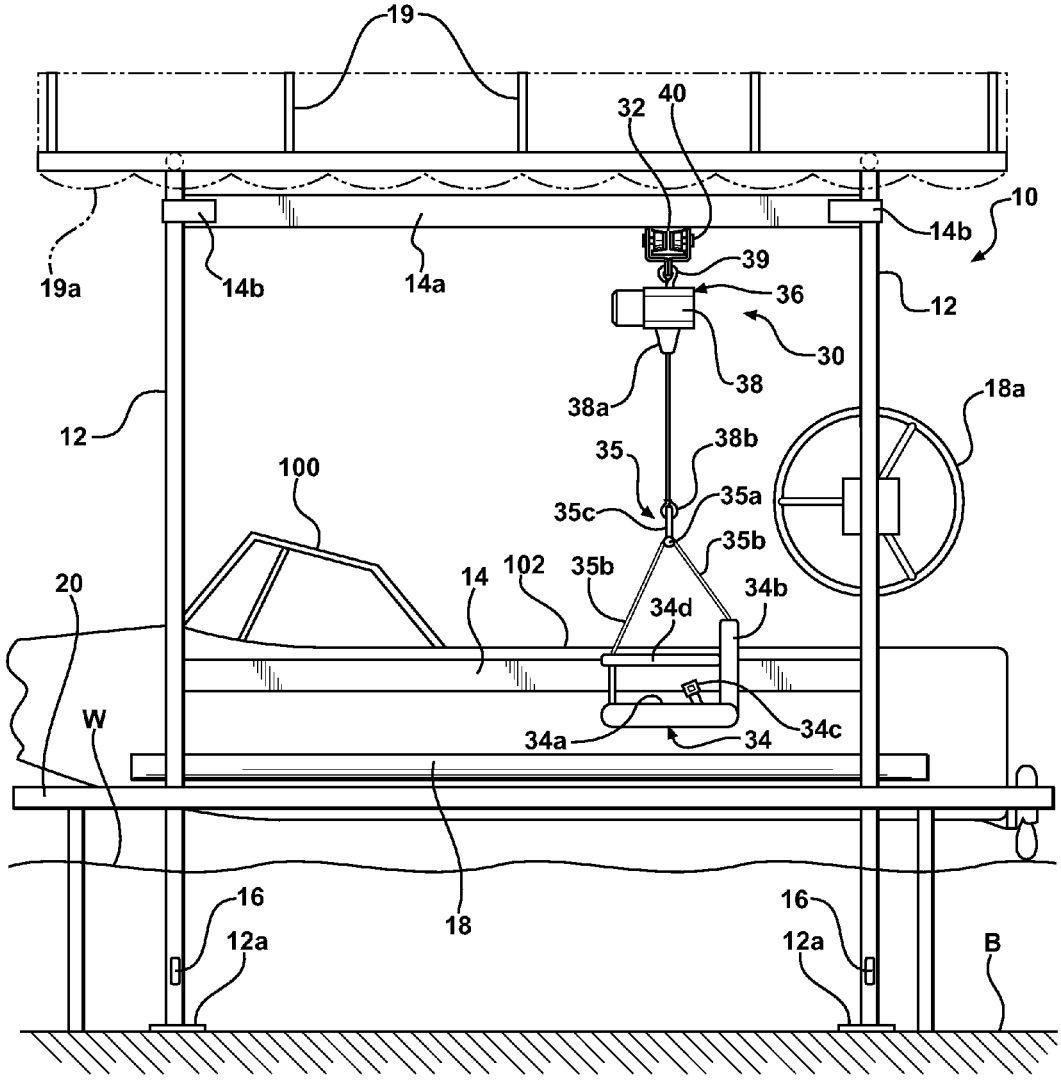
FIG. 2 shows the boat lift of FIG. 1 modified with a personal transfer device according to the present invention.
Figure 3:
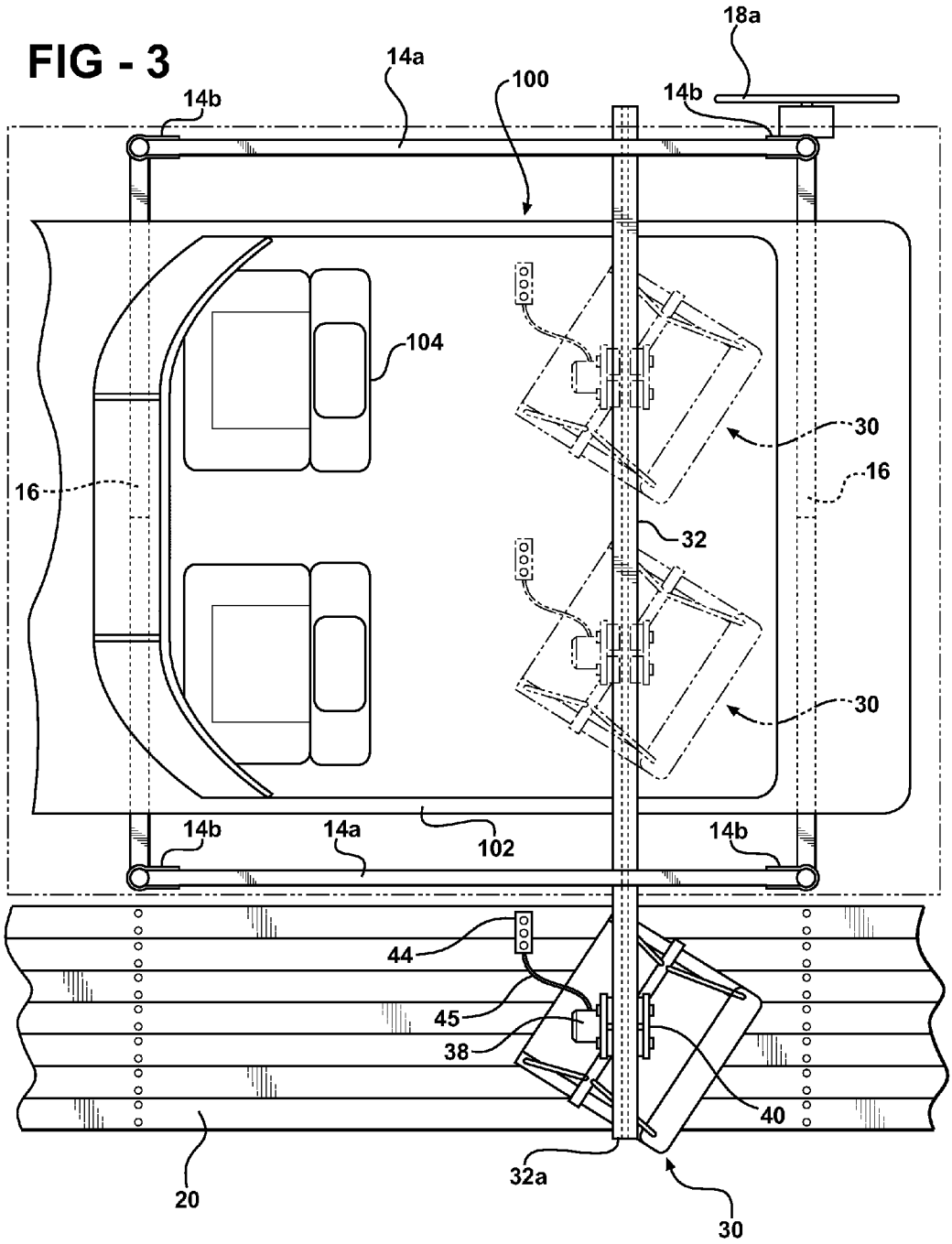
FIG. 3 is a plan view of the boat lift and transfer device of FIG. 2.

Referring next to FIGS. 2 and 3, boat lift 10 has been modified with a personal transfer device 30 according to the present invention. Transfer device 30 includes a cantilevered beam 32 secured to an upper part of the boat lift above the boat, in the illustrated embodiment to the upper side frame members 14*a*. Beam 32 can be secured to the boat lift frame either permanently, for example by welding, or removably, for example by bolting, although other methods for fastening beam 32 to an upper part of a boat lift frame are possible. It will be understood that while beam 32 is preferably fastened across two upper side frame members such as 14*a*, which in the illustrated embodiment have been added to the upper part of the boat lift frame using heavy-duty brackets 14*b* specifically to provide a suitably strong upper frame structure for beam 32, other mounting locations on the boat lift frame are possible as long as they provide adequate structural support for the beam at a location sufficiently high above the boat. If the boat lift frame does not include upper frame members such as 14*a* or a sufficiently strong canopy frame structure above the boat, it would be possible to add suitable frame members to provide a supportive attachment point for beam 32. It is possible both to add beam 32 to an existing boat lift and to originally manufacture a boat lift with beam structure 32.

The free end 32*a* of beam 32 extends out from boat lift 10 over dock 20 to function as both vertical lift support and horizontal travel track for a sling or chair or harness type carrier 34 (hereafter generally referred to as "carrier"). In the preferred and illustrated form, beam 32 generally has an I-beam cross-section, although it would be possible to use other cross-sectional shapes or to use multiple cantilevered beam members that provide the same lift and travel function as the single beam shown. Also, while the term "beam" is used throughout because an I-beam type monorail is the preferred embodiment, it will be understood that the term is not intended to limit the cantilevered support structure 32 to an actual beam, but is intended to include other strong, elongated, cantilever hoist carriage support structures.

Carrier 34 is suspended from beam 32 by a hoist-and-carriage mechanism 36 of the type generally known as a "monorail hoist", capable of raising and lowering carrier 34 vertically and of carrying the raised carrier horizontally along beam 32 between dock 20 and boat 100. For example, the present inventor has successfully tested a commercially available, 1,000-pound+ lift capacity Yale® brand electric shop hoist and trolley for just this purpose, although it must be acknowledged that such off-the-shelf shop hoists often come with "not for human lifting" disclaimers that are apparently for purposes of liability rather than feasibility. Accordingly, it is believed to be possible to use or adapt known shop hoist and/or trolley mechanisms for use in the present invention so that such disclaimers are not necessary.

It will also be understood that while the hoist mechanism 36 is described in its preferred form as using a powered lift mechanism such as an electric (or possibly pneumatic or hydraulic) motor drive for the lift and/or transport functions, similar manual hoist mechanisms are known that would be suitable for use with the invention. It should be further understood that although a monorail hoist is illustrated for use with the preferred monorail beam 32, non-monorail hoists could be used if cantilevered beam 32 is other than a monorail.

Hoist mechanism 36 has a lift drive portion 38 and a trolley carriage 40, which can be integrated in a single housing or (as shown) can be connected to each other by a support 39, for example by a cable or chain or hook or swivel or frame. Lift drive 38 operates a strong, flexible lifting member 38*a* such as a link chain or roller chain or a steel cable, with a connector 38*b* such as a hook or carabiner or snaplink or a heavy-duty closable strap that attaches securely (and preferably removably) to an upper attachment point 35 on carrier 34. Hoist mechanism 36 can typically be powered by 110 VAC shore power that is already available along dock 20 for lighting the dock, recharging boat batteries, powering motor-driven cradle lifts, running power tools and pumps, etc. A suitable power cord 42 (FIG. 4) can be run from a shore-side power source P (FIG. 4) along the length of beam 32, secured for example by clips 42*a* of a type known for use with monorail shop hoists, or by any other suitable means such as cable ties, and connected by common electrical plug or other known electrical connection to hoist 36. If shore power isn't available, hoist 36 could be run by one or more large marine batteries carried by the boat or secured in a housing on the dock or the frame.

Hoist 36 is preferably operated with a handheld push-button control unit 44 (FIGS. 3 and 4) that hangs from the body of the hoist by a cable 45, accessible from carrier 34 for convenient use by a boater secured in the carrier. Such handheld push-button control units are known in the art for hoists of this type, and are usually sealed to be reasonably weatherproof. While a cable connection 45 is illustrated, it is also believed to be possible to use a wireless control connection between handheld remote control unit 44 and the hoist drive. Cable 45 is preferably long enough, or adjustable enough, that a helper could use control unit 44 to operate the hoist while the boater is transferred to the boat in carrier 34. It would also be possible to integrate controller 44 into carrier 34 for operation by the carrier-secured boater alone, or alternately to provide the controller at a remote location (for example at a station on the dock) for operation by a helper or caregiver.

Trolley carriage 40 can be a manual, non-motorized carriage or it can be a motorized or powered carriage of the type known in the art as a "motor trolley" used with monorail and similar hoists and powered by a drive included in the hoist. Both manual and powered carriages suitable for use as trolley carriage 40 are known in the art, typically having a frame 40*a* with wheels or bearings 40*b* mounted to ride on track portions 32*b* on beam 32. It will be understood by those skilled in the art that while beam 32 is illustrated as a preferred I-beam monorail type, it can vary and need not be a single- or monorail, and the type of trolley carriage 40 can vary accordingly to ride or slide back and forth on the corresponding track portion(s) of beam 32.

Figure 4:
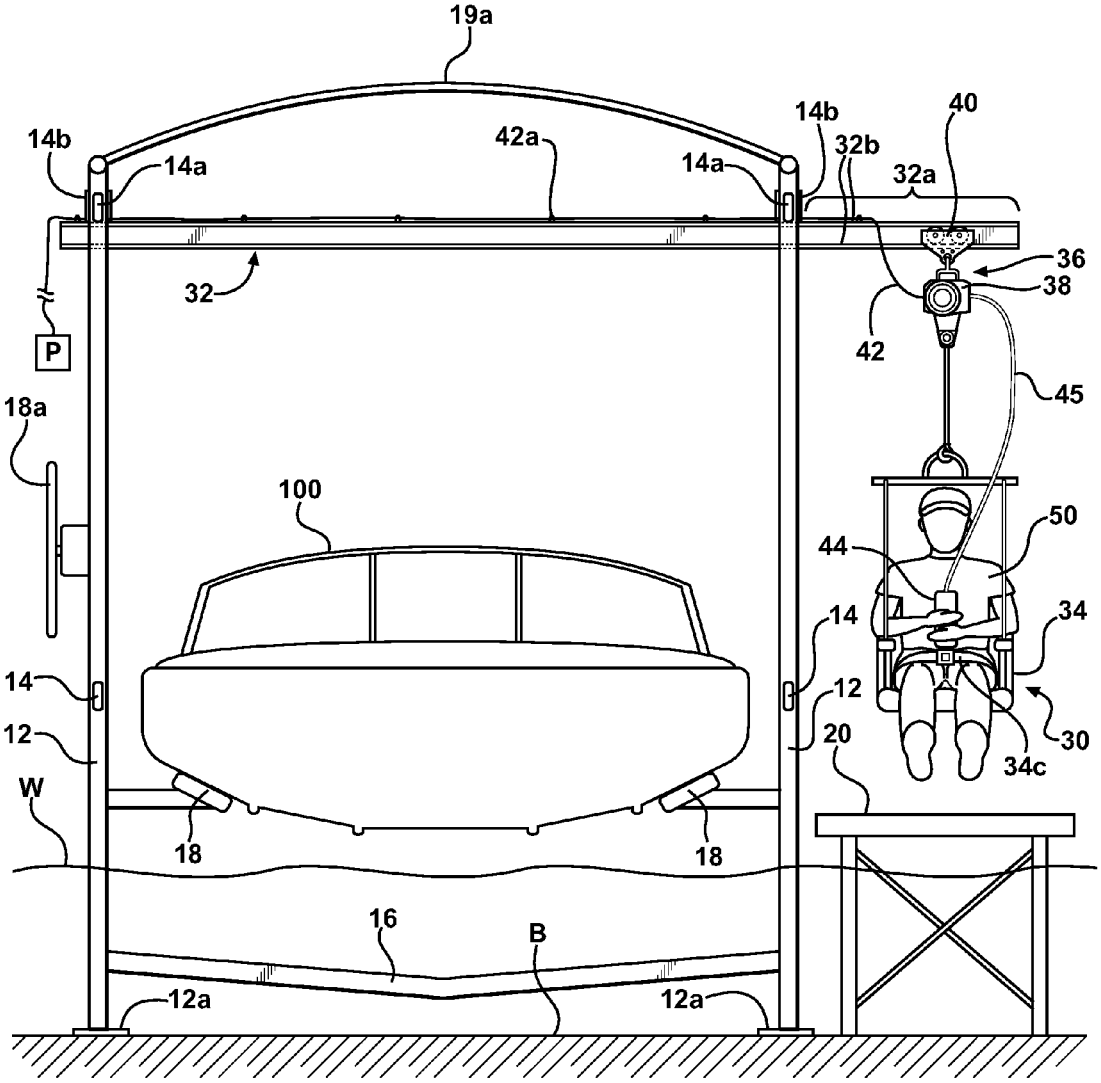
FIG. 4 is an end view of the transfer device of FIG. 2, with a boater secured in the carrier on the dock.
Figure 5:
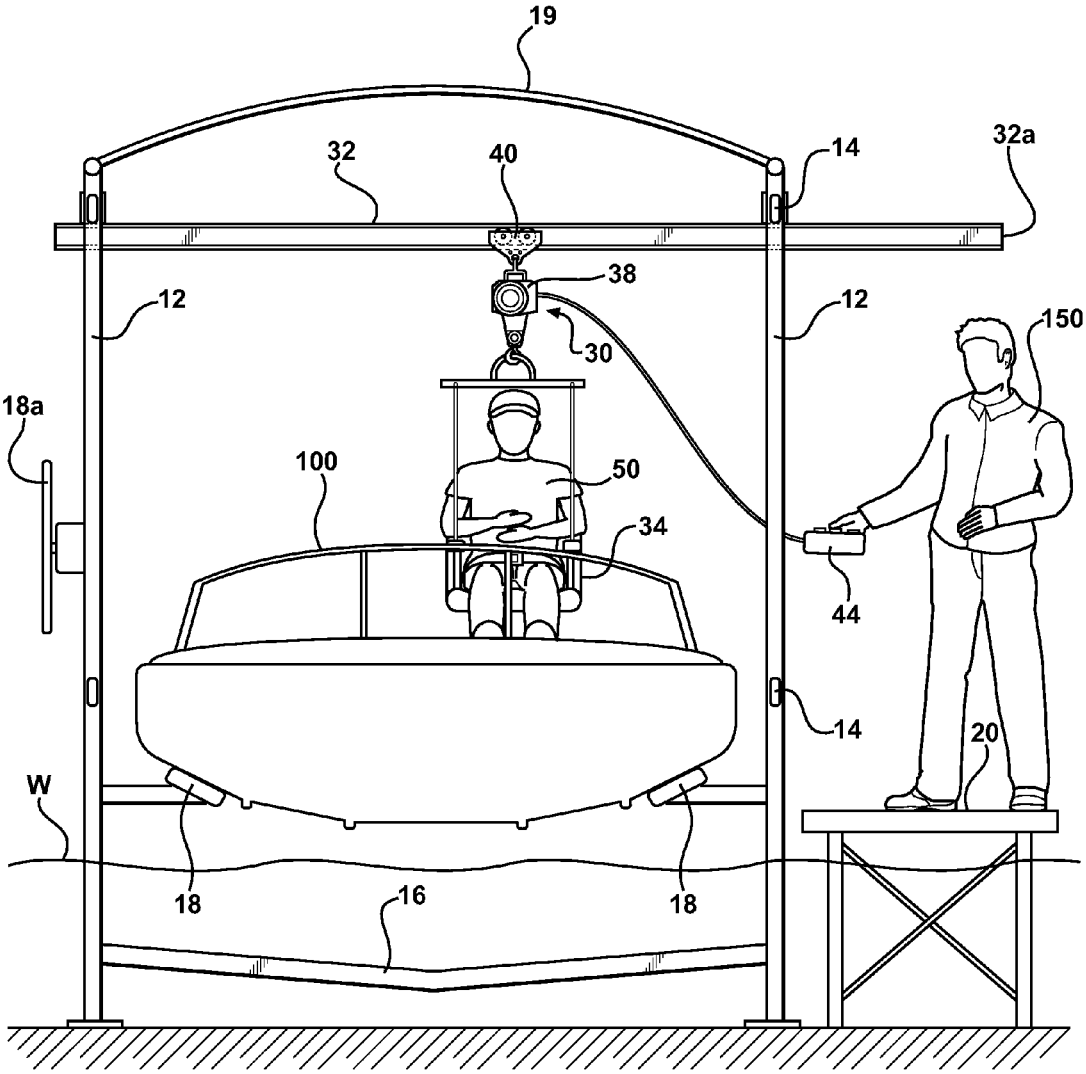
FIG. 5 is similar to FIG. 4B, but shows the boater being assisted by a helper or caregiver.
Figure 6:
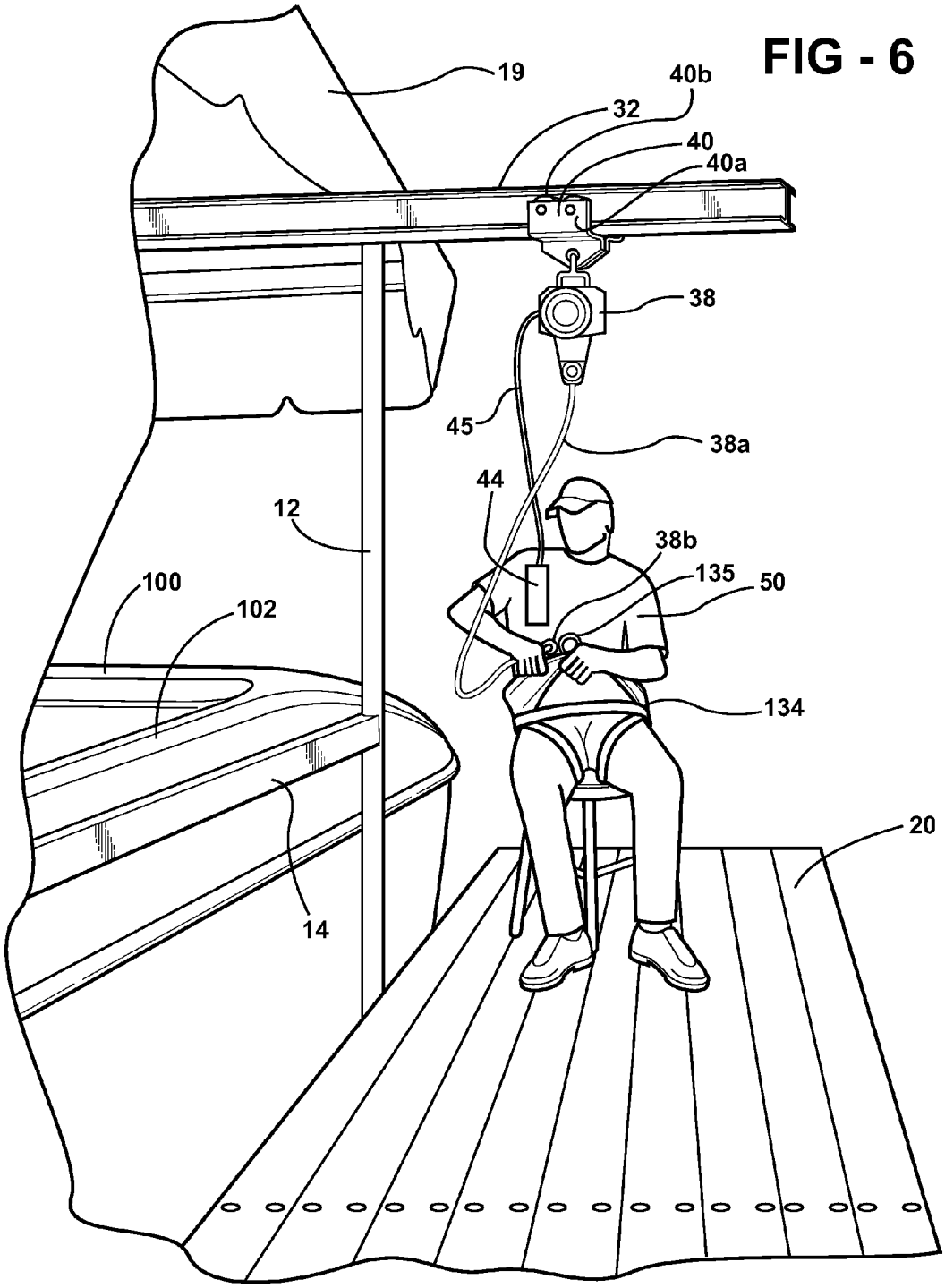
FIG. 6 is a perspective view similar to FIG. 4, but shows a preferred embodiment in which the carrier is detachable from the hoist carriage on the transfer device, and the boater supported at a convenient location such as a chair on the dock while the carrier is attached to the hoist carriage.
Figure 6A:
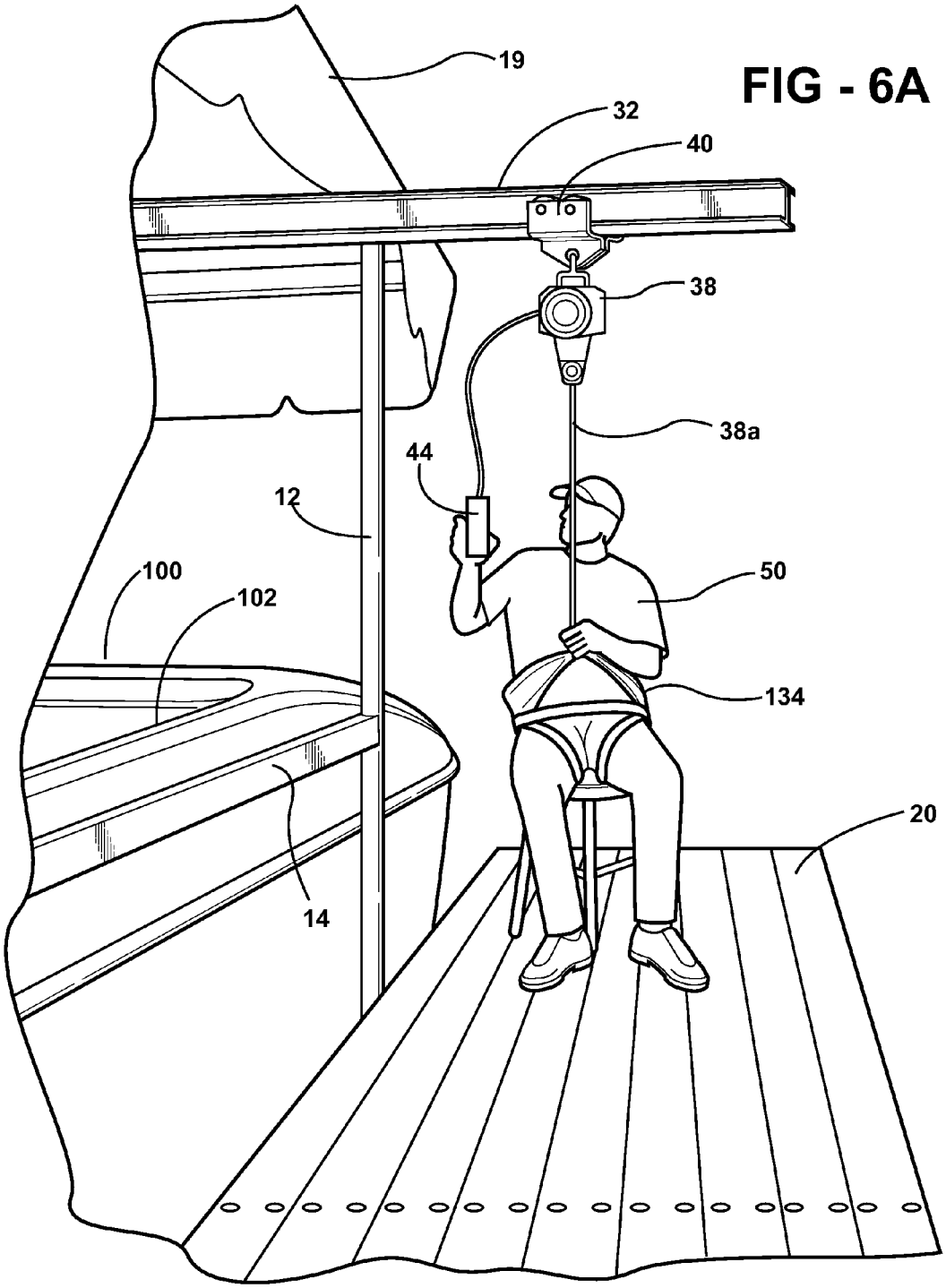
FIG. 6A is similar to FIG. 6, but shows the carrier attached to the hoist carriage to lift the boater off the chair on the dock.

Carrier 34 can be a relatively rigid chair-like device as illustrated in FIGS. 2 through 5 (preferred), or a flexible seat or harness or sling like that shown at 134 in FIG. 6, in any case being sufficiently balanced from its hoist attachment point such that a person sitting or secured with his full weight in the carrier will be balanced and cannot tip too far forward or backward or to either side when being transported. One or more security devices 34*c* of known type such as lap belts, shoulder belts, five-point harnesses, drop-down safety bars, and the like can be supplied on the chair 34 to better secure the person in the chair for a feeling of security and to prevent him from falling out. The size and shape and features of chair 34 (headrest, armrest, rigid chair, flexible harness or sling, degree of occupant containment, etc.) and the specific degree of security offered by any security device 34*c* can be adapted to the individual boater, depending on the particular physical difficulties he may encounter in terms of getting seated, securing himself in the chair, and feeling comfortable and balanced while suspended and transported by the hoist mechanism. It is even possible to use an OSHA-approved wearable fall-prevention type harness that can be clipped to the hoist mechanism 36 as shown in FIG. 6, depending on the boater's physical abilities and comfort level.

That said, in the illustrated embodiment of FIGS. 2-4, a simple chair type carrier 34 is illustrated as one of the simplest carriers possible. Carrier 34 can be made from treated wood or plastic or metal, and have a traditional seat 34*a*, backrest 34*b*, and armrests 34*c*, the rigid chair being suspended from a flexible upper suspension frame 35 including a transverse stainless steel rod 35*a*, stainless steel suspension cables 35*b* attached at balanced points to the rigid chair, and a short loop of stainless cable 35*c* adapted to lockingly and removably receive a clasp hook or similar connector from the hoist mechanism. Which style of carrier is best will depend on the individual boater, his degree of physical ability, and his level of comfort and confidence with different types of carrier.

It will also be understood that carrier 34 (or carrier 134) preferably rotates or swivel relative to the hoist mechanism 36. This is usually possible without special attachments between the carrier and the hoist, since the lift chain 38*a* from hoist 36 is usually mounted to freely rotate relative to the hoist. If not, a rotating attachment point 35 can be supplied between the hoist hook and the carrier, for example using a swivel fitting of known type. Controlled pivoting or swiveling of carrier 34 would be possible, depending on the swivel fitting.

FIGS. 3, 4 and 4A-4B illustrate the operation of transfer device 30 by a handicapped boater 50 on his own. In FIG. 4, carrier 34 has been lowered into a loading position over dock 20, either hanging freely in the air at a convenient height for sitting, or resting on a separate chair or stool or wheelchair or similar support 60 on the dock, where boater 50 can easily seat himself in the carrier 34. Boater 50 can additionally secure himself in carrier 34 with security device(s) 34*c*, for example a strap harness of known type with hook-and-loop or buckle connectors.

Figure 4A:
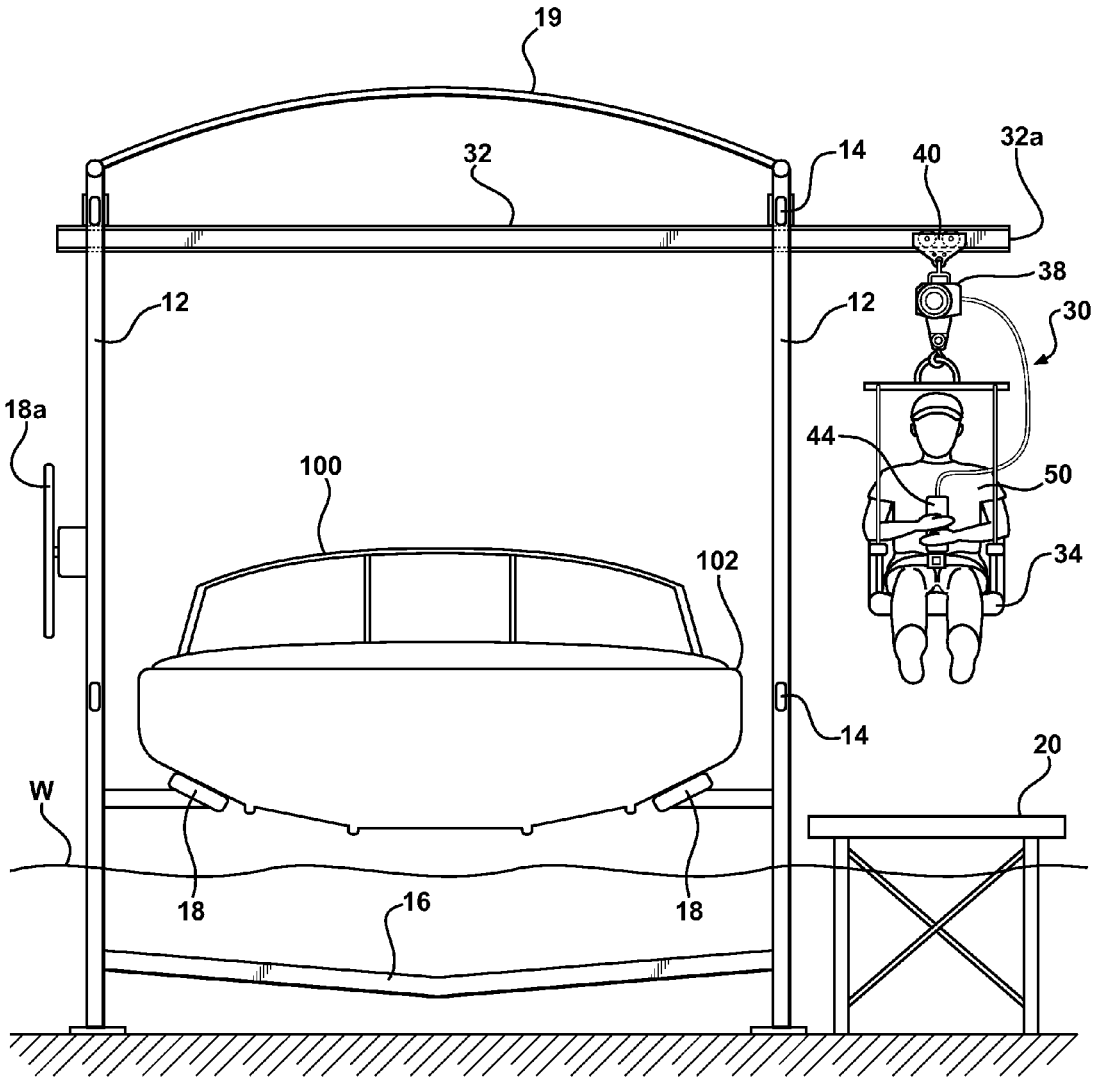
FIG. 4A is similar to FIG. 4, with the carrier and the boater shown lifted above the dock and lift-side obstructions.

In FIG. 4A, boater 50 has operated handheld control unit 44 to raise the carrier 34 to a free-hanging height, either above an optional separate support chair such as 60 or high enough that the boater's legs no longer touch the dock, and where carrier 34 and the boater's legs can clear the lower side frame member 14 on boat lift 10 and the gunwale 102 of boat 100. The clearance between the boater's legs and the side of the boat or any interfering frame members need not be absolute, but should be sufficient that the boater can move his legs over or around any such obstacles while seated in the carrier without too much difficulty or discomfort.

Figure 4B:
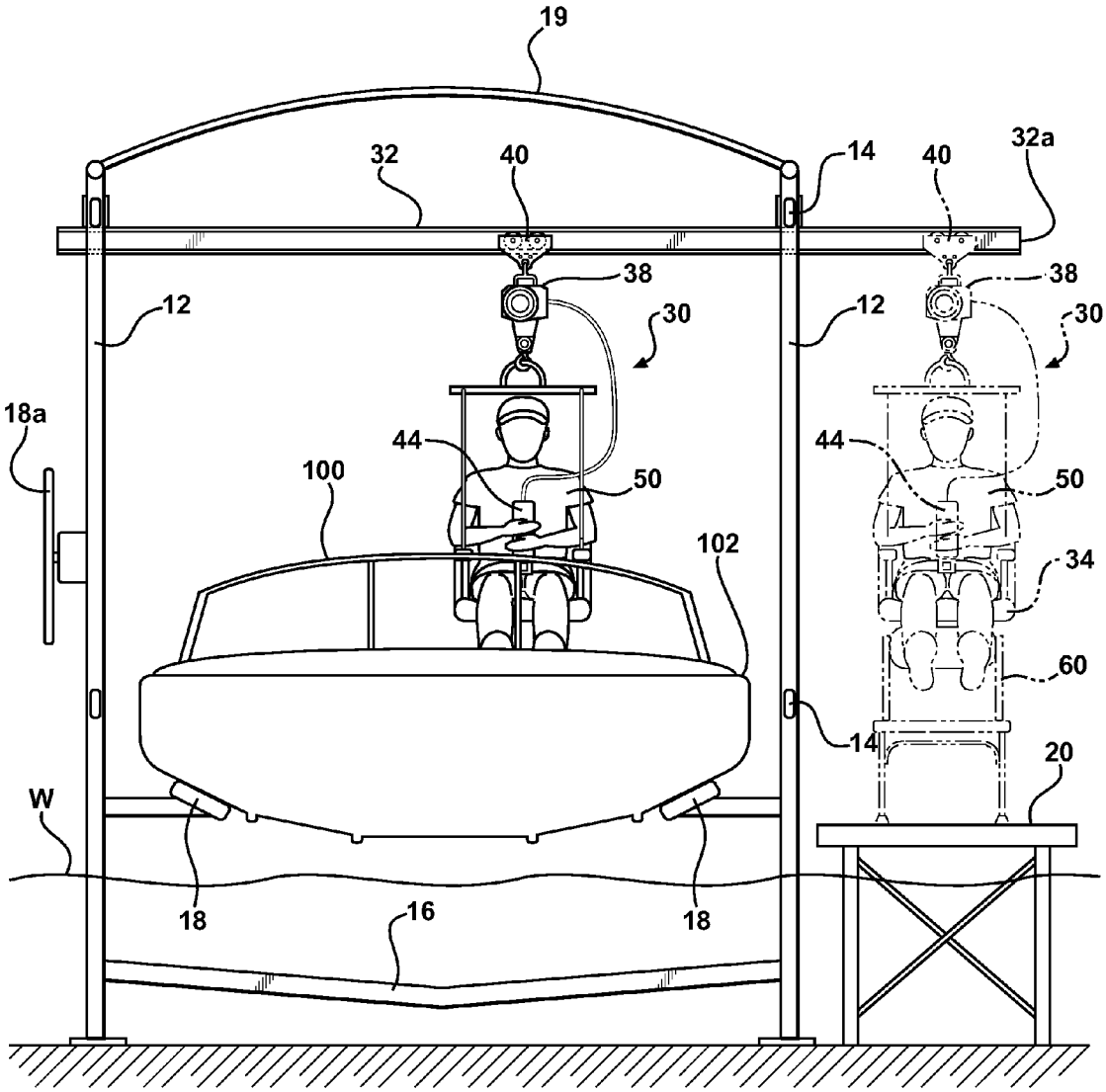
FIG. 4B is similar to FIG. 4, with the carrier having horizontally transferred the boater from the dock to the boat.

In FIG. 4B, boater 50 has used handheld control unit 44 to transport himself horizontally in carrier 34 from a point overhanging dock 20, over the lower side frame member 14 on boat lift 10 (but below upper side frame member 14), over the gunwale 102 of boat 100, and to a point overhanging a convenient unloading spot on the boat, for example a rear deck area near the captain's seat/helm 104 (FIG. 3). Boater 50 then uses handheld control 44 to lower himself onto the boat, where he unfastens and unseats himself, and then re-raises the now empty carrier 34 to a storage position under the boat lift canopy, high enough not to interfere with the boat leaving the boat lift. Carrier 34 can remain hanging in this storage position until the boat returns and is docked in the lift, at which point the boater can reach up and use handheld control 44 to lower the carrier 34 to a convenient seating position. Once seated and secured in carrier 34, boater 50 then operates control 44 in reverse to return himself to dock 20.

Assuming the boater's level of physical ability permits the foregoing on his own, the boater can achieve a wonderful level of independence and self-sufficiency in boarding and disembarking from his boat, since he does not need the usual helper to get on and off.

However, referring to FIG. 5, the same transfer device 30 can be operated by a helper 150 using the same handheld control 44. The helper 150 can thus give boater 50 some assistance getting seated and secured in carrier 34 on the dock, and can use transfer device 30 to lift and horizontally transport boater 50 in carrier 34 across to the boat, following on foot, perhaps moving carrier 34 in stop-and-start stages, using control 44, until the boater is lowered safely onto the boat. Returning boater 50 to the dock is accomplished in the same manner.

FIG. 6 is similar to FIG. 4, except that a portable, detachable, harness type carrier 134 is shown detached from hoist hook 38*b*. This allows boater 50 (or a helper) to remove the carrier from the transfer device 30 for storage; to keep the carrier clean between uses; and to perhaps secure himself to carrier 134 at a more convenient location, for example in a wheelchair or in a nearby house or car (especially useful if using a flexible harness or sling type carrier). Removing carrier 134 between uses also leaves dock 20 completely clear of obstruction, since the cantilevered end 32*a* of beam 32 (and hoist mechanism 36) is preferably situated overhead at a height higher than the expected height of people and equipment likely to move along dock 20. Alternately, carrier 134 can be returned with control unit 44 to a storage position under boat lift canopy 19 between uses. For added security, boater 50 could wear the fall-prevention harness type carrier 134 before seating himself in rigid chair-type carrier 34 shown in the previous Figures. Harness carrier 134 could then be clipped into a backup safety cable secured independently to the trolley frame 40 or some other movable portion of the hoist carriage structure so that a hoist lift cable failure with respect to the chair-type carrier 34 would have no effect on the boater's secure connection to support 32.

While the foregoing examples show transfer device 30 being used to transport the boater 50 along beam 32 using a powered trolley 40 operated by handheld control 44, it will be understood that if a non-powered trolley or carriage is used for the horizontal portion of the transfer, boater 50 can generally push and/or pull himself across from the dock to the boat and back again once raised to a sufficient height to clear the boat lift frame, by swiveling the raised carrier 34 and using hands and feet to grasp or hook convenient portions of the dock, boat lift frame members 12 and 14, the boat's gunwale 102, canopy 19, and various protruding interior pieces of the boat's interior (helm, seats, radio antenna, windshield, consoles, etc.) and "walk" himself across from the dock through the boat lift frame to the boat while suspended in carrier 34.

The transfer device 30 can be used whether boat 100 is in or out of the water, since the vertical lift of carrier 34 or 134 will have enough range to cover both situations, and since the motion of the boat in the water has no effect on the stability of transfer device 30.

It will finally be understood that the disclosed embodiments are representative of presently preferred forms of the invention, but are intended to be explanatory rather than limiting of the invention. Reasonable variation and modification of the invention as disclosed in the foregoing disclosure and drawings are possible without departing from the scope of the invention. The scope of the invention is defined by the following claims.

What is claimed is:

1. In combination with a boat lift, the boat lift comprising a boat-surrounding frame with a mechanism for raising and lowering a boat moored in the boat lift into and out of the water within the frame, the boat lift anchored in the water adjacent a dock, a personal transfer device for transferring a boater from the dock to the moored boat through the boat lift frame and back again, comprising:

a cantilever support secured at one end to an upper part of the boat lift above and extending over a boat moored in the boat lift, the cantilever support having a free end extending out from the boat lift frame above and over the adjacent dock without support from the dock or the boat;

a hoist carriage mounted on the cantilever support, the hoist carriage comprising a lifting mechanism capable of vertically raising and lowering a boater, and a horizontal transport mechanism allowing the hoist carriage to travel along the cantilever support from the dock through the boat lift frame to a position above and over the boat, and back again; and, a personal carrier adapted to carry a boater therein and connected to the hoist carriage to be raised and lowered relative to the dock and the boat, and to be transported by the hoist carriage between the dock and the boat through the boat lift frame with the boater therein.

2. The combination of claim 1, wherein the carrier is removably connected to the hoist carriage.

3. The combination of claim 2, wherein the carrier is removably connected to the hoist carriage, and wherein the carrier is further adapted to be secured to the boater while the carrier is disconnected from the hoist carriage.

4. The combination of claim 1, wherein the carrier includes a security device to secure the boater in the carrier.

5. The combination of claim 1, wherein the hoist carriage includes a powered lift mechanism, and further includes a control unit for operating the powered lift mechanism from the carrier when the carrier is connected to the hoist carriage to operate the powered lift mechanism.

6. The combination of claim 1, wherein the hoist carriage includes a powered transport mechanism, and further includes a control unit for operating the powered transport mechanism from the carrier when the carrier is connected to the hoist carriage to operate the powered transport mechanism.

7. A method for using the combination of claim 1, comprising: providing the combination of claim 1; locating the carrier over the dock at a convenient height for the boater to secure himself in the carrier; the carrier-secured boater operating the hoist carriage to lift himself off the dock; the carrier-secured boater operating the hoist carriage to transport himself along the cantilever support away from the dock, through the boat lift frame, to a point above and over the boat; and the carrier-secured boater using the hoist carriage to lower himself onto the boat.

8. The method of claim 7, wherein the moored boat is in the water.

9. The method of claim 7, wherein the moored boat is out of the water.

* * * * *